United States Patent [19]

Pain

[11] 4,008,651

[45] Feb. 22, 1977

[54] METHOD AND APPARATUS FOR THE FORMATION OF TUBULAR CONTAINERS FROM BLANKS

[75] Inventor: John Herbert Pain, Weybridge, England

[73] Assignee: John Waddington Limited, England

[22] Filed: May 7, 1975

[21] Appl. No.: 575,222

[52] U.S. Cl. ..... 93/81 R; 93/94 PS; 156/218; 156/446

[51] Int. Cl.[2] ..... B31C 1/00

[58] Field of Search ..... 93/77 R, 81 R, 81 MT, 93/94 R, 94 PS; 156/218, 446

[56] References Cited

UNITED STATES PATENTS

| | | | |
|---|---|---|---|
| 537,053 | 4/1895 | Lutz | 93/81 R |
| 2,664,036 | 12/1953 | Triolo | 93/77 R |
| 3,665,819 | 5/1972 | Gardner | 93/81 R |

*Primary Examiner*—Robert Louis Spruill
*Attorney, Agent, or Firm*—Wolf, Greenfield & Sacks

[57] ABSTRACT

A non cylindrical tubular container is formed from a blank creased to delineate contiguous hexagonal cells. The blank is provided with tabs at one edge which engage in slots in a mandrel having a pair of hexagonal ends between which extends a contoured surface that initiates folding of the blank about its creases. The blank is first partially wrapped around the stationary mandrel and glue is applied to the free end of the blank. Wrapping is completed by rotating the mandrel so that the ends of the blank overlap. The overlapped ends are pinched together by a presser bar that pushes the ends against the mandrel. The completed tubular container is then pulled off the mandrel by gripping one edge of the container and pulling it endwise away from the mandrel.

9 Claims, 17 Drawing Figures

METHOD AND APPARATUS FOR THE FORMATION OF TUBULAR CONTAINERS FROM BLANKS

This invention relates to the formation of tubular containers from blanks, and in particular concerns a method of forming the containers and a machine for forming the containers. The invention also provides containers erected according to the method.

The invention has best application to the formation of rigid tubular containers i.e. tubular containers which are not designed to be capable of being folded to flattened sleeve or "skillet" form, but it is also applicable to the "lay-flat" tubular containers which are adapted to be so collapsed to the flattened sleeve or skillet form by having diametrically opposite lengthwise crease lines.

In our British Pat. No. 1,385,975 we have set forth novel forms of blanks which are for rigid containers and which are creased so as to define one or more cellular panels or facets. The cellular panels or facets are such that suitable folding of the blank induces creasing of the blanks around the cellular areas so that the cellular areas recess, giving the folded blank a novel and attractive appearance.

The present invention has one aim to provide a means and method for erecting the containers set forth in our British Pat. No. 1,385,975 as such containers cannot be erected by conventional methods, but the invention in principle can be applied to the erection of other forms of rigid containers as well as lay flat containers.

According to a first aspect of the invention there is provided a method of constructing a tubular container from a blank wherein a first edge of the blank which is to lie lengthwise of the container is maintained in fixed relationship relative to a mandrel adapted to the cross sectional shape required of the erected container, and the blank is wrapped round the mandrel causing the container to take up said required cross sectional shape and a second edge of the blank and said first edge overlap, and securing together said first and second overlapped edges.

The blank preferably has tab means in one of the lengthwise edges, which tab means locates in a slot or slots in the mandrel to maintain the fixed relationship of the blank relative to the mandrel during the wrapping.

The said overlapped edges are preferably glued together, and preferably the glue is applied to the blank during the wrapping thereof, and the gluing together is effected by a pressure bar means which extends longitudinally of the container and which has a profile matching the cross sectional shape of the container at said overlapping edges, the mandrel being correspondingly shaped at said overlapping edges so that the overlapped, glued edges are pressed together radially of the mandrel between the mandrel and pressure bar means.

The blank preferably is provided with creasing depending upon the final shape which the erected blank is to assume. This shape may be triangular, polygonal, hexagonal and so on, but in a particular case, the blank is provided with creasing defining interfitting hexagons and half and quarter hexagons, so that the container when formed has hexagonal ends which are aligned, and at spaced intervals along the length of the container the hexagonal cross section alternates between a position aligned with the ends, and a position displaced by 30° relative to said first mentioned position. Where the blank is to be erected to circular form, it will have no creasing apart perhaps from crease lines defining said tab means.

The blank may carry end flap means or panels to close one or both of the formed container ends, or the container may be constructed so as to be closed by separate ends, for example hexagonal moulded plastics ends.

The blank preferably is formed by being partially wrapped round the mandrel while the mandrel is stationary, and then the mandrel is rotated by one revolution.

The invention also extends to containers constructed according to the method as aforesaid.

Also according to the invention there is provided a machine for constructing a tubular container from a blank, said machine having a mandrel adapted to the cross sectional shape required of the erected container, and provided with slot means to receive tab means of the blank at a first edge of the blank which is to lie lengthwise of the container, to maintain such lengthwise edge of the blank in fixed relationship relative to the mandrel, means whereby the blank can be wrapped round the mandrel to cause the blank to take up said required container shape and so that a second edge of the blank and said first edge overlap, and means for pressing together the first and second overlapped edges to effect securing of said edges together, by glue, heating sealing, welding or the like.

Preferably, the machine is for constructing a tubular container from a blank having cell panels defined by creasing, and the mandrel is such that the wrapping of the blank round the mandrel induces folding at the creasing and the cell panels creases inwardly.

The machine preferably has means defining a feed tray for a blank, said mandrel having an initial position in which the mandrel slot means is positioned to receive the tab means of the blank, said means defining the tray having a portion which is movable round the mandrel, partially to wrap the blank round the mandrel, the means whereby the blank may be wrapped round the mandrel comprising a drive for rotating the mandrel by one revolution. The machine may include a glue applicator for applying glue to the second edge of the blank after it has been partially wrapped round the mandrel. The glue applicator preferably has a glue bar which is adapted to move up out of a glue bath to meet and contact the free edge of the blank as it completes its partial wrapping round the mandrel.

The machine preferably has a discharge means whereby the formed container can be withdrawn or pushed axially off the mandrel.

The machine preferably is adapted to operate for a complete cycle comprising wrapping the blank and securing the overlapped edges and discharging the formed container, following initiation of the operation of the cycle by manual actuator means, the machine having a control and drive arrangement to enable such operations to take place in sequence during a cycle of operation.

The machine is preferably adapted to receive and form a blank provided with creasing defining interfitting hexagon shapes and half and quarter hexagon shapes, so that the container when formed has hexagonal ends which are aligned, and at spaced intervals along the length of the container a hexagonal cross-sectional alternates between a position aligned with the ends, and a position displaced by 30° relative to said first mentioned position, said mandrel having appropriate hexagonal ends between which there is a center portion having a peripheral region which follows a portion of the inner surface of the container to be formed and has the slot means therein, the center portion being of smaller cross sectional area than that of the hexagonal ends. One of the ends preferably is in separable sections, one section being secured to the center portion and the other section being removable with the discharge means.

An embodiment of the present invention will now be described by way of example, with reference to the accompanying drawings wherein.

Figure 1:
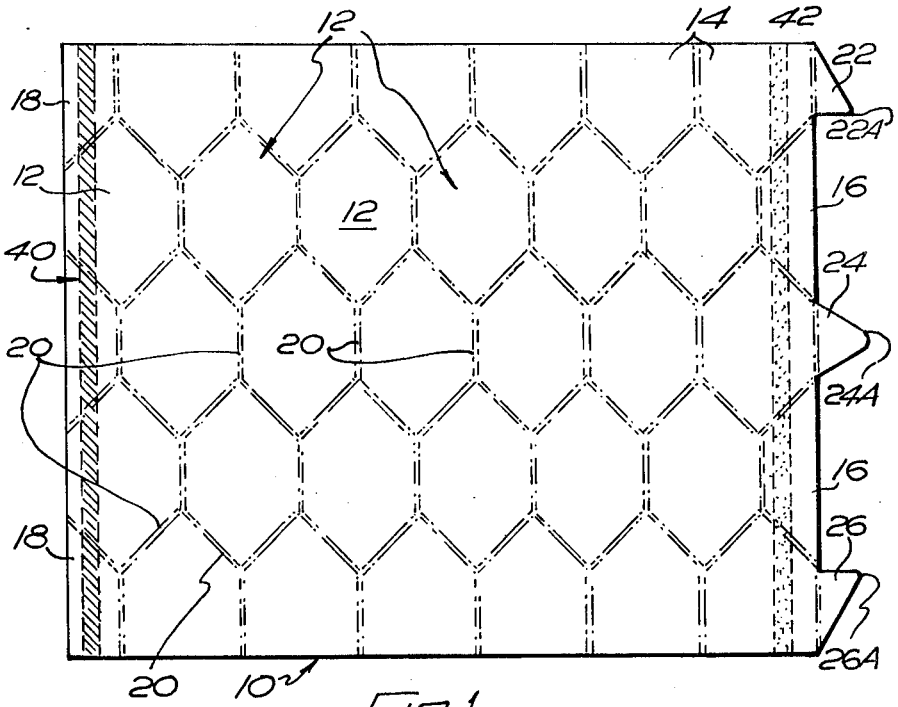
FIG. 1 is a plan view of a blank suitable for forming by the method of the invention.

Referring firstly to FIGS. 1 — 4, in these figures there is shown a blank, and the steps involved in forming this blank into a tubular container or novel and attractive appearance. The blank is shown in FIG. 1 and will be seen to generally rectangular. It is identified by reference numeral 10. The blank is divided into a plurality of elongated hexagonal shaped and interfitting cellular areas 12 and half hexagonal cellular areas 14 and 16 and quarter hexagonal cellular areas 18, by means of suitable creasing lines 20, which may be defined by conventional creasing or other suitable lines of weakening. These lines 20 are indicated in chain dotted configuration in FIGS. 1, 2 and 3, and are referred to hereinafter as lines of creasing.

Figure 2:
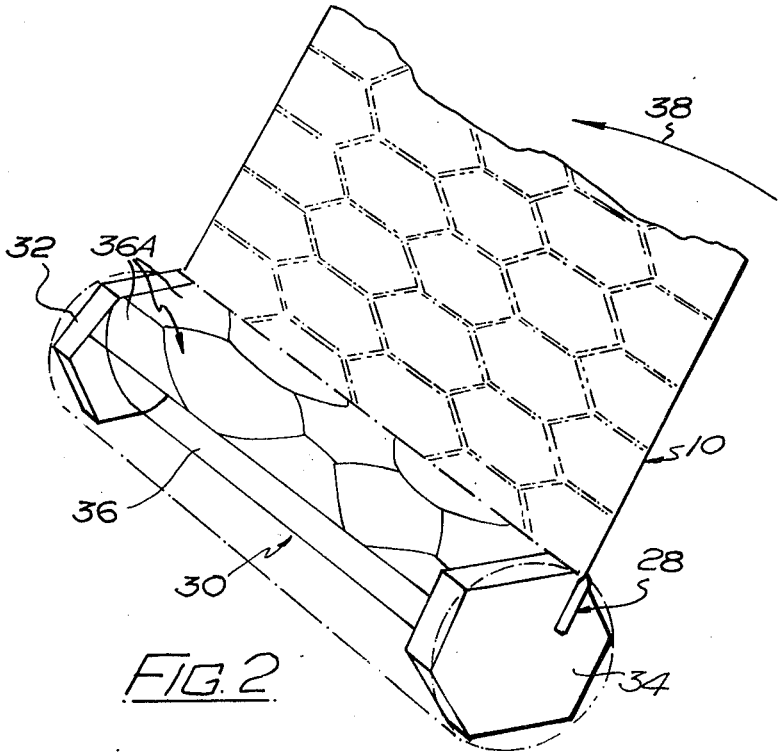
FIG. 2 illustrates diamgrammatically how the blank of FIG. 1 can be fed to a mandrel to be formed into a container be being wrapped therearound.

At one edge the blank 10 is provided with three tabs 22, 24 and 26, tabs 22 and 26 being identical but symmetrically disposed relative to tab 24. Each of the tabs 22, 24 and 26 is provided with a rounded end 22A, 24A and 26A, to enable the easy insertion of such tabs into a mandrel slot 28 (FIG. 2). The mandrel is indicated in FIG. 2 generally by the reference numeral 30. It will be seen that this mandrel has two hexagonal ends 32 and 34 of which the flat length is equal to the flat dimension of each hexagonal cellular area 12 of the blank 10 transversely of the blank. The hexagonal ends 32 and 34 of the mandrel are connected by a center piece 36 which has on a peripheral surface extending for 1½ flats of the hexagonal ends 32 and 34, a profiled shape defined by hexagonal and part hexagonal facets 36A, which match the shape of the interior of the container to be formed from the blank 10.

Figure 3:
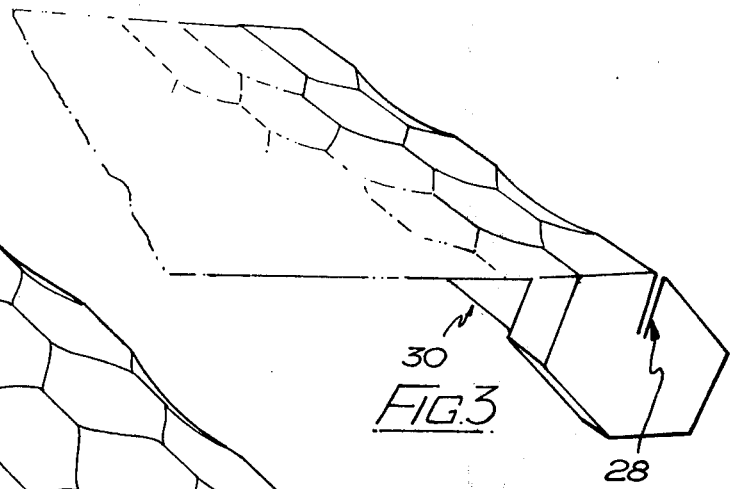
FIG. 3 shows the blank of FIG. 1 partially wrapped round the mandrel of FIG. 2.
Figure 4:
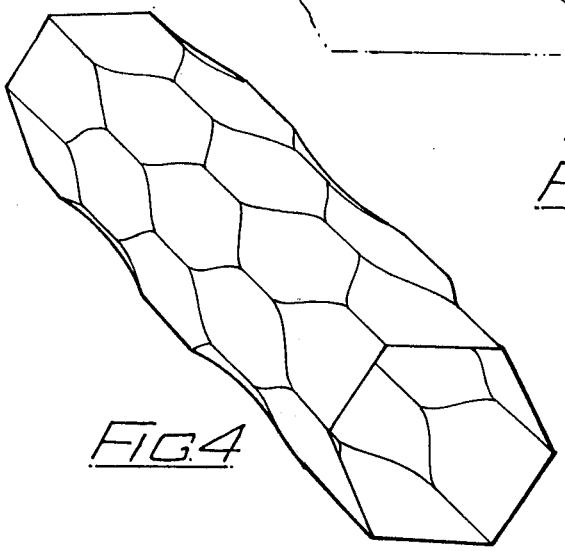
FIG. 4 shows the fully wrapped blank of FIG. 1 after being removed from the mandrel of FIG. 2.

The said container is shown in FIG. 4 and will be seen to comprise a tubular formation having hexagonal ends which are in alignment, and along the length of the tubular container the hexagonal cross section aligned with the ends alternates with a similar hexagonal cross section which is displaced by 30° relative to the aligned ends. The formation of the tubular container shown in FIG. 4 is by wrapping the blank 10 from its position shown in FIG. 2, around the mandrel 30. In FIG. 3 the first stage of the wrapping operation is shown, and it will be noticed that the blank has been wrapped round the mandrel as indicated by arrow 38 in FIG. 2 partially round the mandrel 30 the mandrel having remained stationary during this stage of wrapping. At this time, the free end of the blank 10 engages a glue bar, not shown in FIGS. 1 to 4, but discussed in detail later, so that a line of glue is applied to the blank along the area indicated by reference numeral 40 in FIG. 1. Area 40 is indicated by cross hatching lines. This area 40 eventually is applied to the stipled strip area 42 also indicated in FIG. 1, when the formation of the blank is complete. From the position shown in FIG. 3, the blank is completely wrapped round the mandrel by turning the mandrel through one complete revolution. This causes the free edges of the blank to overlap so that areas 40 and 42 are in exact register above a region of the mandrel defined by the facets 36A. At this time a suitably shaped pressure bar moves radially of the mandrel and presses together the overlapped areas 40 and 42, so that same become firmly glued together. After this operation, the blank, now in its tubular form shown in FIG. 4 is withdrawn axially of the mandrel, and to this end one of the end pieces 32, is formed in separable sections, one of the sections being integral with the mandrel portion 36, and the other section being capable of axial withdrawal from the mandrel portion 36, taking with it the formed blank.

During the wrapping of the blank 10 around the mandrel 30, creasing along lines 20 of the blank is induced, so that the blank over its entire surface in the formed container, has a recessed facet appearance.

Figure 5:
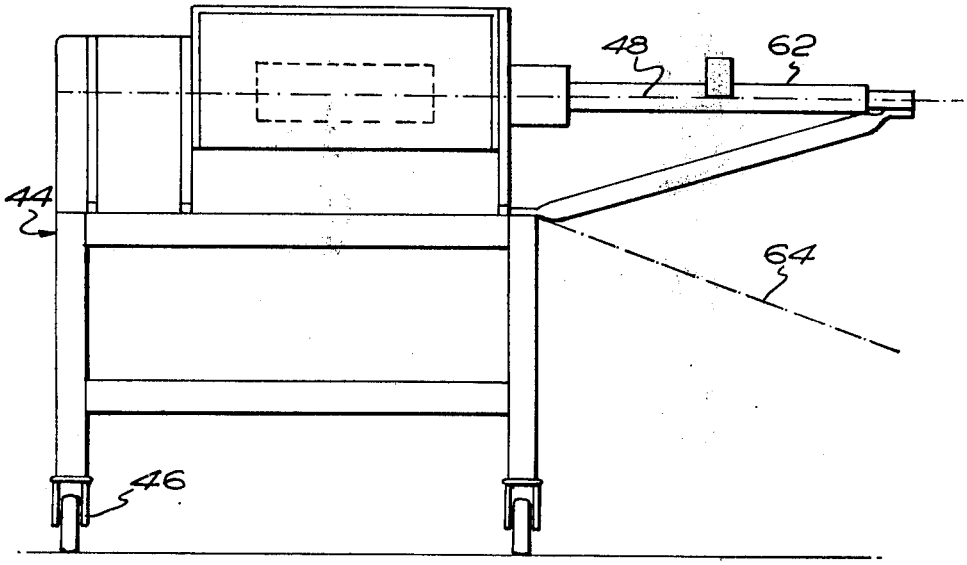
FIG. 5 is a general assembly drawing showing a side view of the machine according to the invention, which is for forming the blanks as illustrated in FIGS. 1 to 4.
Figure 6:
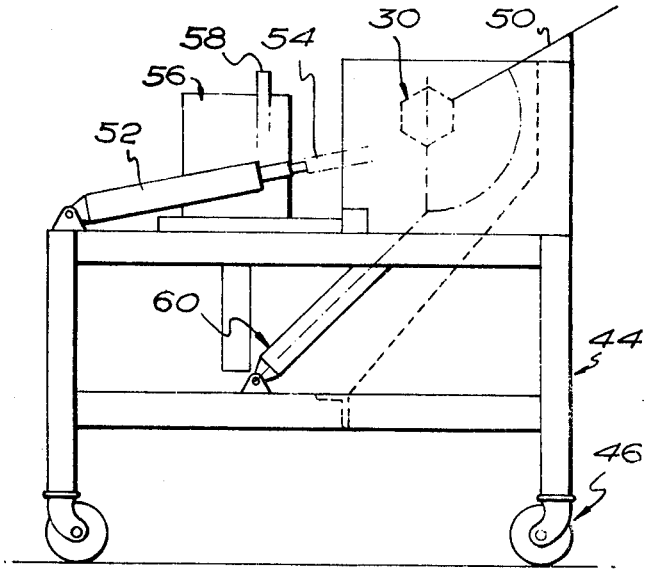
FIG. 6 is a general assembly drawing in end view, of the machine shown in FIG. 5.

The machine for forming the blank as already described, will now be described in detail. Referring firstly to FIGS. 5 and 6, it will be seen that the machine comprises basically a chassis 44 which is carried on wheels 46 so that it can be moved from place to place. The mandrel 30 has a horizontal axis of rotation 48 and a feed tray means in the form of a plate 50 lies radially with respect to axis 48. The feed tray 50 is for supporting blanks 10 in turn to be formed into the containers of FIG. 4 and may be provided with a leading magazine for feeding of individual blanks from a stack of blanks. The pneumatic ram 52 shown in FIG. 5 is for driving the mandrel through one revolution and to this end is connected to a rack 54 which engages a toothed wheel (not shown in these figures) which is adapted to drive the mandrel 30 through a one way clutch arrangement.

The gluing unit is indicated by numeral 56 and the glue bar by numeral 58. This glue bar 58, which lifts during each cycle of operation to meet the partially folded blank, is adapted to dab adhesive onto the free edge of the blank as explained previously. The ram unit 60 is adapted to move part of the tray 50 around the axis 48, in order to effect the partial formation of the blank, i.e. the position shown in FIG. 3 so that such blank will meet the glue bar 58. The pneumatic ram 62 shown in FIG. 5 is for retracting part of the hexagonal end 32 of the mandrel, in order to withdraw a completely formed blank from the machine, also as explained previously with reference to FIGS. 1 to 4. When the ram 62 has retracted the formed blank sufficiently clearly of the remainder of the mandrel, it releases the formed blank to allow it to fall onto a discharge chute 64 as shown in FIG. 5.

The ram 60 for rotating the mandrel 30 is shown in FIG. 6, and it will be seen that it is connected to an arcuate plate 66 which is supported on guide rollers 68, to ensure that the plate 66 moves circumferentially around the mandrel axis 48. There is a similar plate 66 at the other end of the mandrel, but ram 60 is connected only to the one of said plate 66 shown in FIG. 7. Extending between the plates 66 is a support shaft 70 which carries towards each end thereof, a support arm 72. On a free end of each support arm 72, there is a pressure roller 74 which is located in exact axial register with the adjacent hexagonal end 32 or 34 of the mandrel 30, so that such roller 74 will engage such end during the rotation of the mandrel. A further arm 76 firmly connected to the shaft 70, and acted upon by a spring 78, ensures that the rollers 74 are held in spring engagement with the mandrel ends 32 and 34.

A pneumatic ram 80 which is pivotally connected to one of the plates 66 is pivotally connected to one of a pair of identical levers 82 at the respective ends of the mandrel, and these levers 82 carry a pressure bar 84, which can be moved through removable tray portion 50A, through a gap 86 therein, in order to apply radial pressure to the overlapped edges of the blank when it has been completely formed into the tubular container as described previously. These levers 82 are carried by the plate 66 on aligned pins 84.

Figure 9:
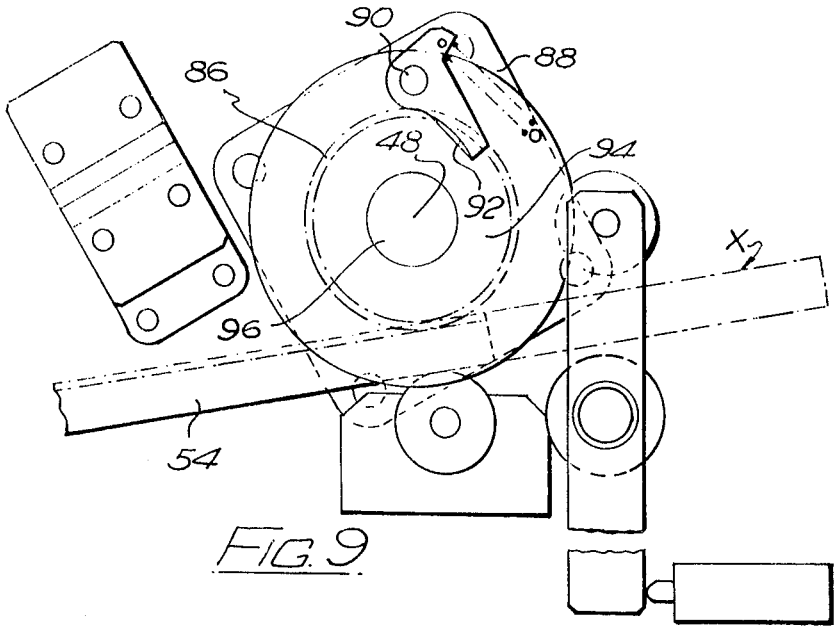
FIG. 9 is an end view, similar to FIG. 7, showing the one way clutch arrangement for driving the mandrel.

Turning now to FIG. 9, the mandrel axis is shown again at 48, and in FIG. 9 the rack bar 54 is shown. It will be seen that this rack bar 54 engages a gear wheel 86 coaxial with axis 48. This gear wheel 86 forms part of an assembly including a plate 88 integral with the gear wheel, and plate 88 carries a spring loaded pawl 90, shown in FIG. 9 as engaging a notch 92 in a boss 94 which is pinned to the shaft 96 to which the mandrel 30 is secured. When the rack bar 54 moves to the position shown at X in FIG. 9 the gear wheel 86, which is free to rotate on shaft 96 simply revolves taking with it the plate 88 and the pawl 90, and the mandrel 30 is not rotated. However when the rack 54 returns to the position shown in FIG. 9, by virtue of engagement of pawl 90 in notch 92, the shaft 96 and the mandrel 30 connected thereto are rotated. The gear wheel 86, plate 88 and pawl 90, in conjunction with the boss 94 and its notch 92, form in effect a one-way clutch driving arrangement.

Figure 14:
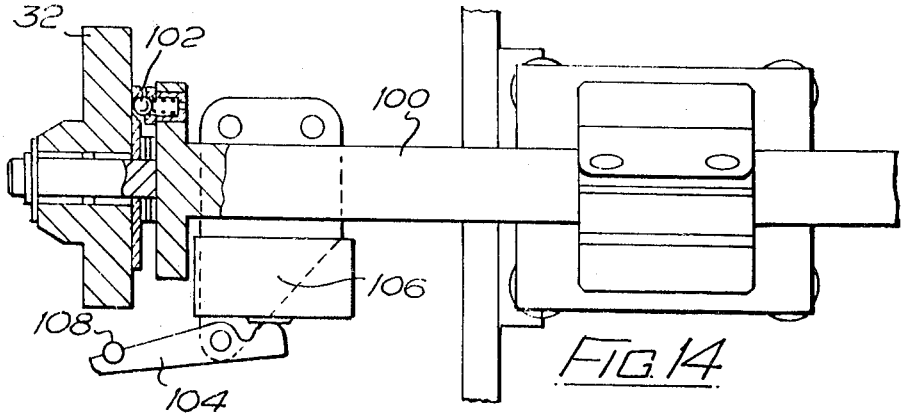
FIGS. 14 and 15 are respectively a front view and an end view showing the formed container extraction mechanism.
Figure 15:
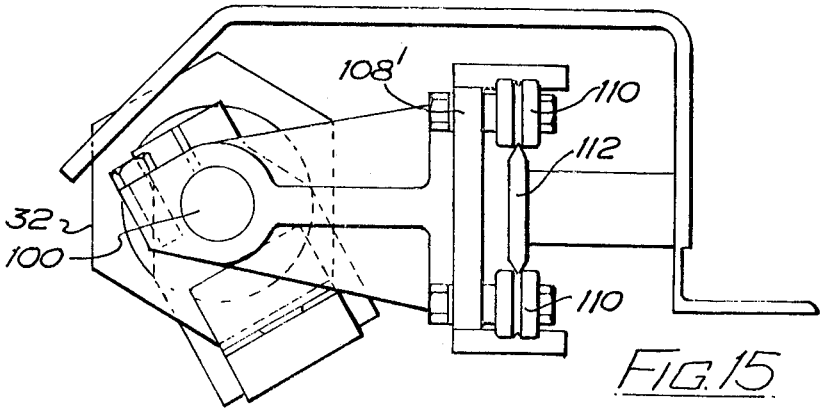
Figures 10, 11, 12, 13:
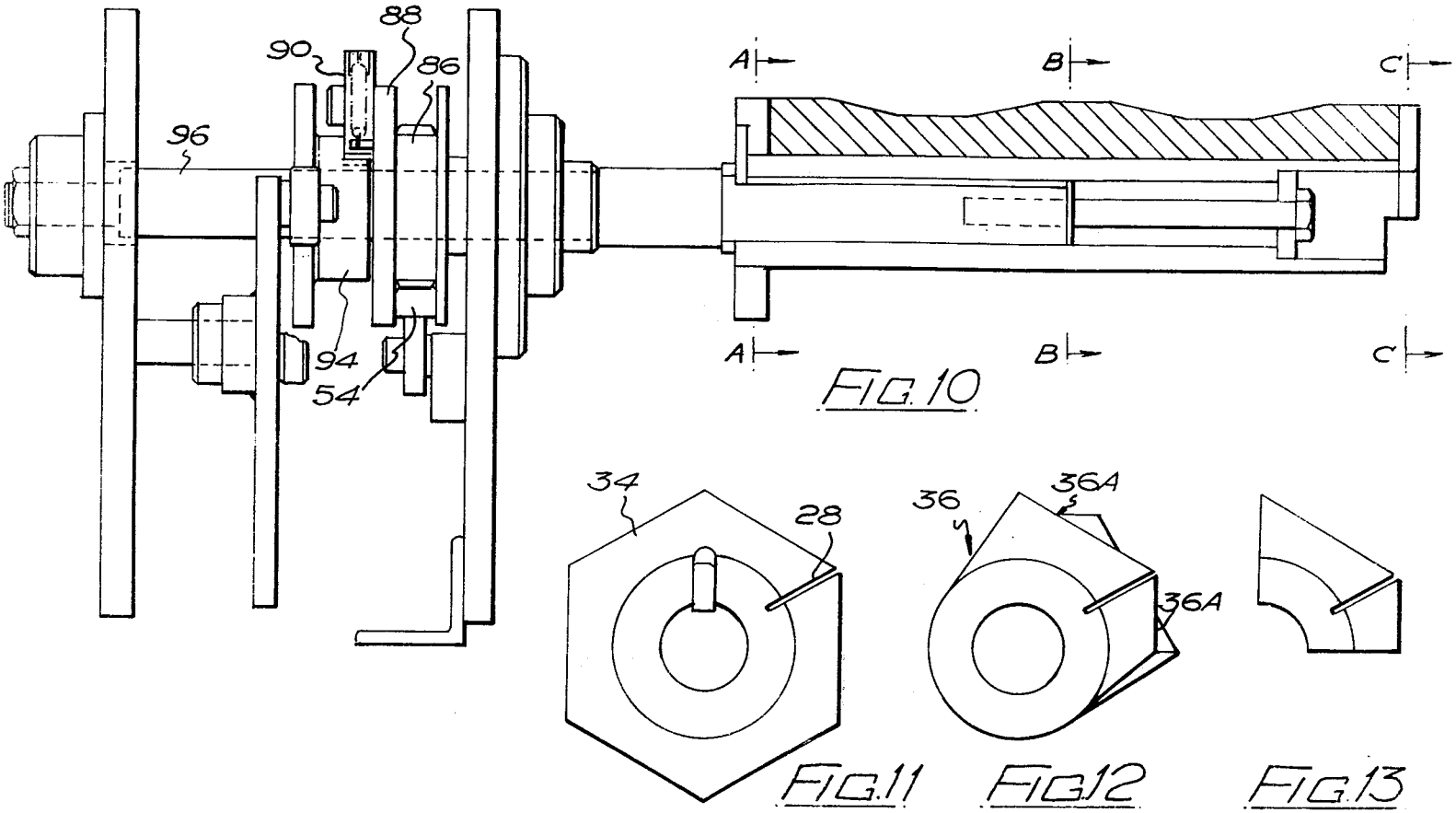
FIG. 10 is a front view of the arrangement shown in FIG. 9.
FIGS. 11, 12 and 13, are sectional end views of the mandrel, respectively taken on lines A—A, B—B, and C—C of FIG. 10.

The variation in mandrel cross section along the length thereof, is shown by FIGS. 11, 12 and 13. The hexagonal end 34 of the mandrel is shown in FIG. 11 as is the slot 28, while FIG. 12 shows clearly the unusual cross-sectional shape of the mandrel at the center region of portion 36, the facets 36A also being shown. FIG. 13 shows that only one quarter of the hexagonal end 32 is an integral part of mandrel section 36. The remainder of this hexagonal end 32 is fast with the formed container extraction mechanism. This mechanism is shown in FIGS. 14 and 15, and referring to such figures, the remaining part of the hexagonal end 32 is shown as being connected to the end of a shaft 100 which is disposed co-axially with the mandrel axis 48. The remaining part 32 of the hexagonal end is rotatable relative to such shaft 100 but one or more spring loaded balls 102 tend to keep the proportion of end 32 in the exact registered position relative to the other part of the end, so that when the two are moved together, they will fit exactly. The means whereby the formed blank will be clamped to the part of the hexagonal end 32, shown in FIG. 14 and in FIG. 15, comprises a pivot lever 104 carried by a bracket 106 connected to shaft 100 adjacent the hexagonal part 32. This lever 104 has a clamping pad 108 at one end thereof, which is adapted to bear against one of the flats of the hexagonal end part 32, upon being moved into such engaging position by a pneumatic clamping cylinder, which acts on the lever 104. FIG. 15 shows that the shaft 100 is carried by a bracket 108, having spaced guide rollers 110. These rollers 110 run on a horizontal guide rail 112, and the assembly comprising shaft 100, the clamping mechanism 104, 108, the part of the hexagonal end 32 are movable on the guide rail 112 by means of the ram 62 shown in FIG. 5.

Figure 7:
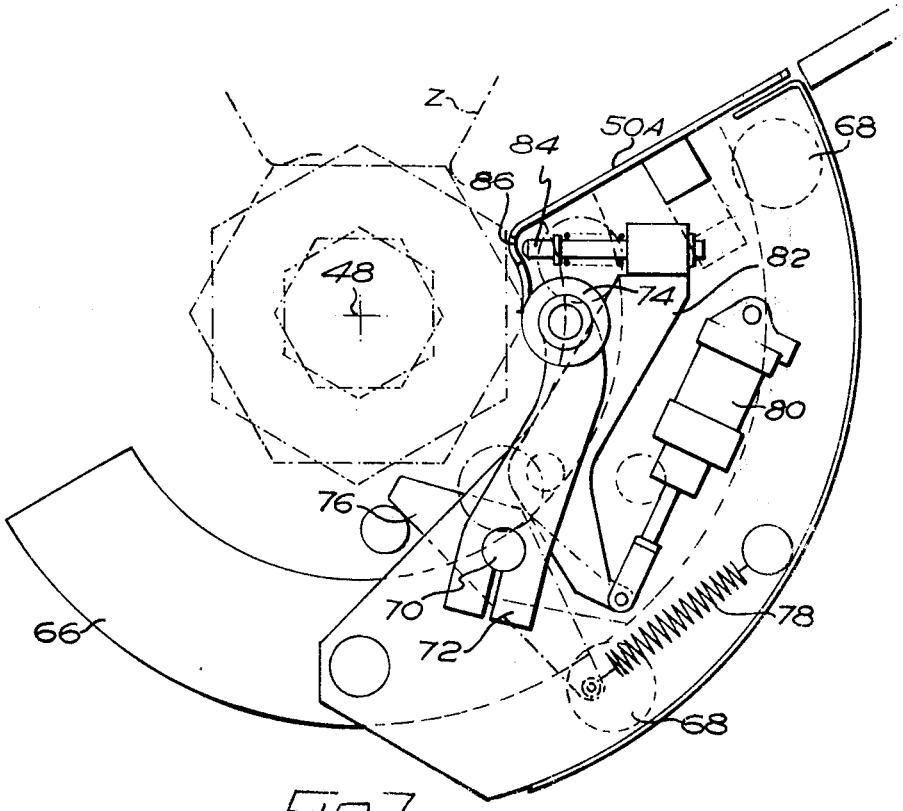
FIG. 7 is a side view, similar to FIG. 5, showing the end of the mandrel of the machine shown in FIG. 5.
Figure 8:
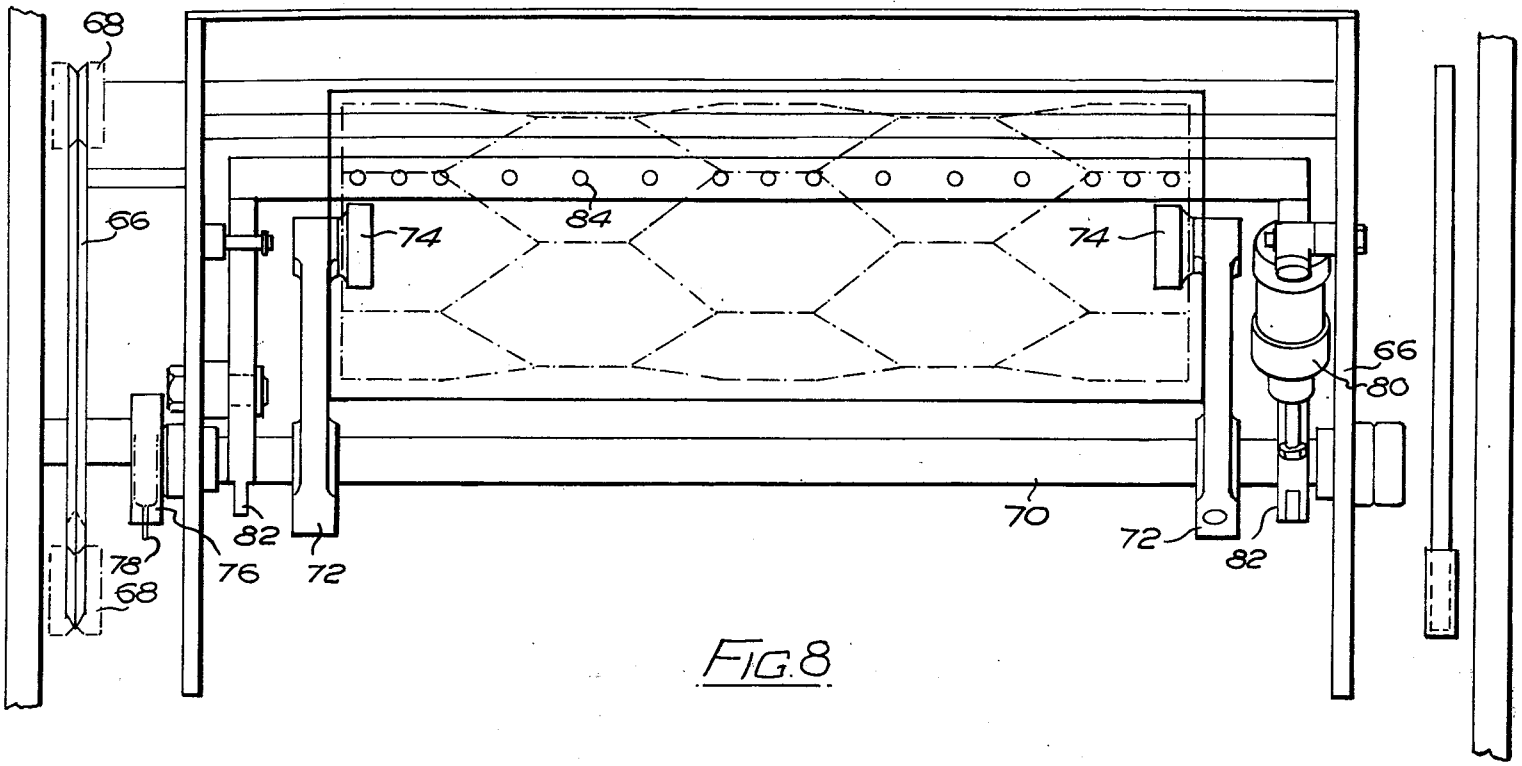
FIG. 8 is a front view of the mandrel shown in FIG. 7.
Figure 16:
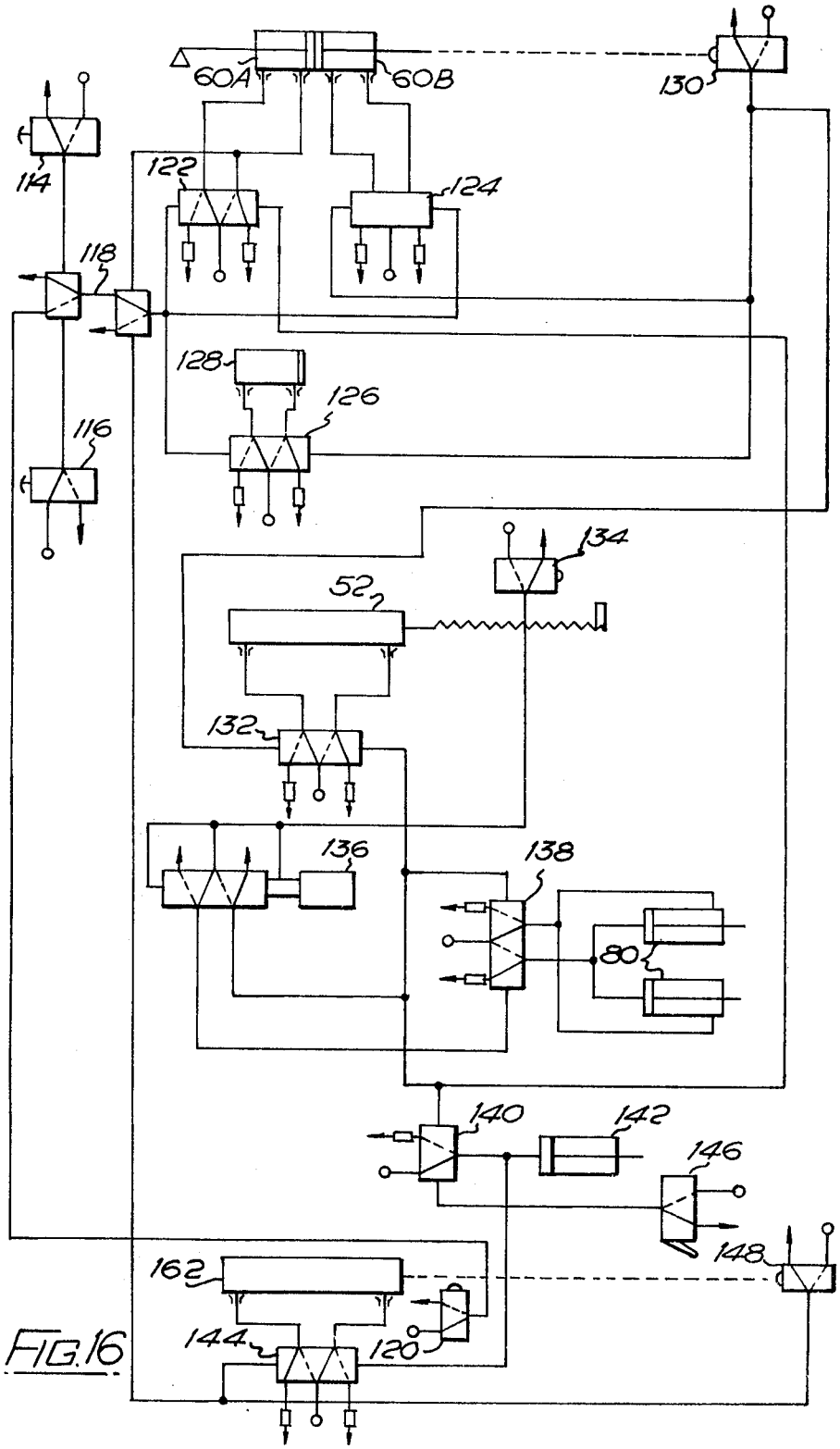
FIG. 16 is a circuit diagram showing the pneumatic control system of the machine shown in FIGS. 5—15.
Figure 17:
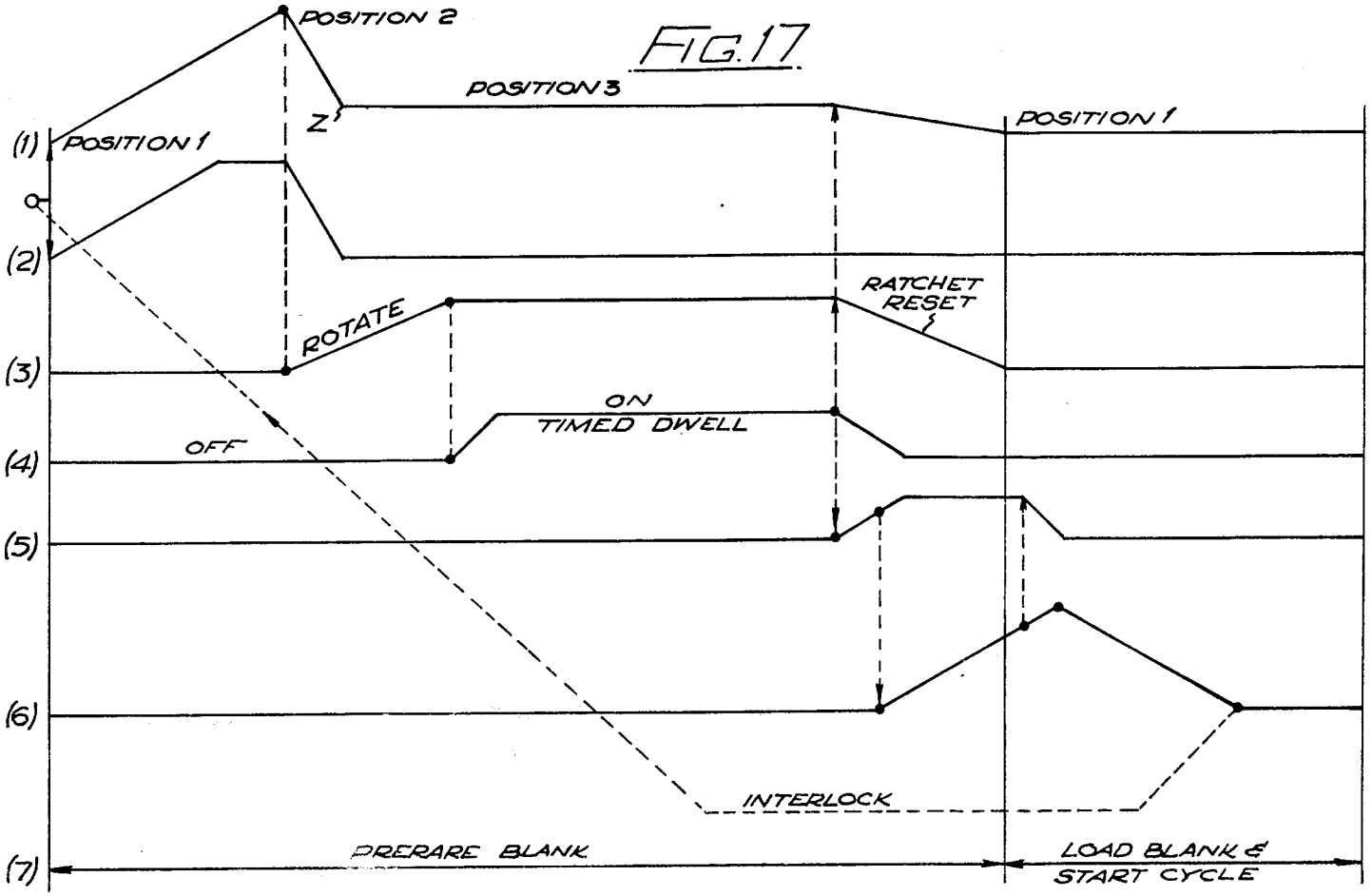
FIG. 17 shows time base graph illustrating the phase relationship of the machine component movements during one cycle of operations.

Referring now to FIGS. 16 and 17, in FIG. 16 there is shown a pneumatic circuit included in the machine for controlling the cycle of operations, whilst FIG. 17 shows to a time base graphs of the inter-relationship of the movements of the various components of the machine during a cycle of operations. Considering firstly FIG. 16, in order to start a cycle of operations, after the machine has been loaded with a blank positioned on tray 50 with the tab 24, 22, 26 of the blank engaged in slot 28 of the mandrel, the two start valves 114 and 116 are depressed, and air under pressure is supplied to outlet 118, provided that an unload complete valve 120, has signalled that the previous cycle of operations has been completed. The supply of air under pressure to outlet 118 conditions valves 122, 124 and 126. Valves 122 and 124 control the forming cylinders 60A and 60B, which are connected back to back and together form ram 60, while valve 126 conditions a glue bar raising cylinder 128. The effect of this is that the combined cylinders 60A and 60B are extended displacing the blank round the mandrel to the position (FIG. 3) in which its free edge abuts the glue bar 58 (FIG. 5). The full extension of the ram 60 actuates a valve 130 which causes the supply of air under pressure to a mandrel rotation controlling valve 132, and the result is that ram 52 is contracted, rotating the mandrel 30 by one revolution. At the completion of one revolution, the mandrel 30 conditions a release valve 134 enabling mandrel ram 52 to return to its previous position, and during such return the mandrel is not rotated as the clutch arrangement previously described freewheels. Simultaneously with the conditioning of valve 132 by valve 130, the valve 124 is also conditioned, causing cylinder 60B, but not cylinder 60A to contract and the movable part 50A of the tray returns to a position which is shown in FIG. 7 by letter Z, which is displaced by 30 relative to the position shown in FIG. 7, and in an anti-clockwise direction.

With the actuation of the mandrel ram 52, a timer 136 is set in operation, controlling the supply of pressure air to a valve 138, which in turn controls the pressure bar rams 80. The arrangement is that when the tray portion 50A has returned to the position Z shown in FIG. 7, the pressure bar rams 80 are extended, causing the pressure bar 84 to press the overlapped and glued edges against the mandrel 30, as previously described. With this operation a pulse of pressure fluid supplied to a valve 140, conditioning same to operate a grip cylinder 142, which operates the gripper arm 104, (FIG. 14), so that the formed blank is gripped against the portion of the hexagonal end 32 which can be withdrawn from the remainder of the mandrel. The pneumatic signal to cause operation of the grip cylinder 142 conditions valve 144, to cause operation of the retraction cylinder 62, and the formed blank is withdrawn from the mandrel for discharge. Towards the end of the discharge travel a trip valve 146 is operated, causing the supply of pressure fluid to valve 140 to release the grip of grip cylinder 142, whereby the formed blank can fall to the discharge chute 64. This movement to discharge the formed blank from the mandrel operates a further conditioning valve 148, which permits the supply of pressure fluid to reverse valve 144, and results in the return of cylinder 62 to the initial position. In returning, cylinder 62 operates the said valve 120 to permit an enabling signal to be transferred to the valve controlled by valves 114 and 116 and the cycle can be repeated.

The time base graphs shown in FIG. 17, from top to bottom respectively show the movements of (1) the movable tray portion 50A, (2) the movement of the glue bar, (3) the rotation of the mandrel, (4) the movement of the pressure bar, (5) the movement of the gripper cylinder 142, (6) the movement of the retraction ram 62, and (7) the "prepare blank" and "load blank and cycle restart" times. It will be seen from FIG. 17 that the operation can be readily ascertained. In the first stage, the tray part 50A moves round the mandrel to its maximum position, and at the same time the glue bar moves upwardly the glue bar reaching its up position before the tray part 50A completes its increment. Next the tray part 50A returns to the intermediate position (position Z in FIG. 7 and FIG. 17) while the glue bar returns to its initial position, and at the same time the mandrel commences rotation. At the end of mandral rotation, the pressure bar is applied to the overlapped edges of the blank for a predetermined period, and at the same time the ratchet drive to the mandrel returns to the initial position. At the end of said dwell period, the pressure bar is retracted, the tray part 50A returns to the initial position and the unload gripper arm 104 grips the formed blank for a preset time, and a short time after retraction of the pressure bar and application of the gripper arm 104, the retraction ram 62 withdraws the formed blank while it is gripped by the gripper arm 104. The gripper arm next releases, and the retraction ram 62 continues its movement. During such continued movement a knock off finger may be arranged to push the formed container from the part hexagonal end 32. Finally, the retraction ram 62 returns to the initial position, and causes the sending of an enabling signal back to the manual initiation valves 114, 116, and the cycle can be repeated. Where a load magazine is provided, this enabling signal can be used to cause automatic loading of the next blank.

It is appreciated that modifications of the machine may be made from the scope of the invention and different sized parts may be fitted for the formation of blanks of differing shapes and sizes.

The invention also extends to the erection of containers of a less complicated cross section than the container illustrated in FIGS. 1 to 4. For example, the principle can be applied to the erection of containers having a constant cross-section shape, such as circular, triangular, or multi-sided having four or more sides, and while it is best suited for the erection of rigid containers as hereinbefore described, there is no reason why it cannot be applied to the erection of containers which can be flattened into skillet form for transportation.

Where the machine described is modified for the erection of constant cross sectional shape containers (tapered or parallel sided) the machine can be more simple in construction, as the specific form of mandrel construction and extraction mechanism described with reference to the drawings arises only because of the complicated and varying cross sectional shape of the container illustrated in FIG. 4. For a container of simpler construction, such as circular, or triangular or other multi-sided form, the mandrel will be of simpler form and the extraction mechanism can simply be a pusher, adapted to push the formed container off the mandrel into a suitable receptacle, the only requirement of the mandrel being that the wrapping causes the blank to take up the final container shape.

Instead of the formed containers passing to a collecting receptacle, they may pass directly to a conveyor, such as the conveyor of an automatic loading line at which the goods are automatically loaded into the containers.

In the arrangement described with reference to the drawings, to achieve the wrapping of the blank, during one portion of the wrapping, the mandrel is stationary whilst the blank is wrapped therearound, and during another portion of the wrapping, the mandrel is rotated. The effect can be achieved by keeping the mandrel stationary at all times, or by effecting the wrapping completely by rotation of the mandrel. To have such modified arrangements, it may be necessary to vary the gluing step, or to use pre-glued blanks, and some other modifications of machine may be required.

Where the blank is of or has applied thereto heat sealable material, the seam may be made by heat sealing, in which case a glue applicator would be unnecessary, and the pressure bar would include or be comprised of a heat sealing bar.

I claim:

1. A method of constructing a non-cylindrical tubular container from a blank creased to delineate cells, comprising the steps of 1. providing a mandrel having a non-cylindrical contoured surface conducive to initiating folding of the blank about its creases,
2. causing a first edge which is to extend lengthwise of the container to be held in fixed relationship on the mandrel,
3. wrapping the blank around the mandrel to cause the blank to fold about its creases and take a tubular shape,
4. causing a second lengthwise edge of the blank to overlap the first lengthwise edge of the blank, and
5. causing the overlapped edges to be joined together by pinching the overlapped edges together between a presser bar and the contoured surface of the mandrel.

2. The method according to claim 1 of constructing a tubular container from a creased blank wherein the step of wrapping the blank around the mandrel is accomplished partially by rotation of the mandrel and partially by wrapping the blank around the mandrel while the mandrel is stationary.

3. The method according to claim 2 of constructing a tubular container from a creased blank, further including the step of 6. applying glue to the second lengthwise edge during the wrapping step and while the mandrel is stationary.

4. A machine for constructing a non-cylindrical tubular container from a blank creased to delineate cells and having tabs extending from one edge of the blank, comprising

1. a mandrel having a non-cylindrical contoured surface conductive to initiating folding of the blank about its creases, the mandrel having slot means for receiving the tabs of the blank,

2. support means for positioning the blank to enable the tabs of the blank to enter the slot means of the mandrel,

3. means for causing the blank to be wrapped around the mandrel to form a tube having overlapped edges extending lengthwise of the tube,

4. a presser bar spaced from and extending along the mandrel, and

5. means for moving the presser bar toward the mandrel whereby the overlapped edges are pinched between the presser bar and the contoured surface of the mandrel.

5. A machine according to claim 4 for constructing a noncylindrical tubular container, wherein the means for causing the blank to be wrapped around the mandrel includes means for causing the mandrel to rotate and wherein the machine further comprises 6. means for causing the mandrel to resume an initial position in which the slot means is positioned to receive the tabs of the blank.

6. A machine according to claim 4, further including 6. a glue applicator, and 7. means for activating the glue applicator after the blank has been partially wrapped around the mandrel whereby glue is applied to one edge of the blank before completion of the wrapping operation.

7. A machine according to claim 6, wherein the glue applicator has a glue bar which is adapted to move up out of a glue bath to meet and contact the free edge of the blank while the blank is partially wrapped around the mandrel.

8. A machine according to claim 4 for constructing a tubular container from a blank creased to define contiguous hexagonal cells and portions of such cells whereby the completed tubular container has aligned hexagonal ends and the hexagonal cells intermediate the ends alternate between a position aligned with the end cells and a position displaced therefrom, wherein the non-cylindrical contoured surface of the mandrel includes end portions of hexagonal shape between which there extends a surface shaped to conform to the hexagonal cellular arrangement of the blank, and the conforming surface extending only part way around the hexagonal end portions.

9. A machine according to claim 8, wherein one of the hexagonal end portions has a separable section and the machine further includes means for pinching the formed tubular container against the separable section, and means for moving the separable section endwise away from the remainder of the mandrel whereby the tubular container is pulled off the mandrel.

* * * * *